United States Patent [19]

Hanada et al.

[11] Patent Number: 4,847,657

[45] Date of Patent: Jul. 11, 1989

[54] ELECTROPHOTOGRAPHIC APPARATUS FOR DEPOSITING DEVELOPER ONLY ON THE IMAGE AREA OF THE IMAGE BEARING MEMBER

[75] Inventors: Shinji Hanada, Kawasaki; Takayuki Ishihara, Tokyo, both of Japan

[73] Assignee: Canon Kabushiki Kaisha, Tokyo, Japan

[21] Appl. No.: 245,960

[22] Filed: Sep. 16, 1988

Related U.S. Application Data

[63] Continuation of Ser. No. 869,873, Jun. 3, 1986, abandoned.

[30] Foreign Application Priority Data

Jun. 4, 1985 [JP] Japan ..... 60-119814

[51] Int. Cl.[4] ..... G03G 15/08

[52] U.S. Cl. ..... 355/218; 355/265; 355/245

[58] Field of Search ..... 355/7, 3 DD, 14 D; 118/647, 657

[56] References Cited

U.S. PATENT DOCUMENTS

| | | | |
|---|---|---|---|
| 3,999,849 | 12/1976 | Maksymiak et al. | 355/3 DD |
| 4,292,923 | 10/1981 | Huggins | 355/3 DD |
| 4,326,795 | 4/1982 | Tajima et al. | 355/14 D X |
| 4,382,420 | 5/1983 | Ohnuma et al. | 118/651 |
| 4,469,429 | 9/1984 | Okamato et al. | 118/647 X |
| 4,521,103 | 6/1985 | Ohtsuka et al. | 118/647 X |
| 4,600,294 | 7/1986 | Suzuki et al. | 355/14 D |
| 4,659,211 | 4/1987 | Oka | 118/657 X |
| 4,678,314 | 7/1987 | Uchida et al. | 355/14 D X |

*Primary Examiner*—A. C. Prescott

*Attorney, Agent, or Firm*—Fitzpatrick Cella Harper & Scinto

[57] ABSTRACT

An electrophotograpic apparatus and an electrophotographic process wherein when a developer is to be deposited on such an area of a latent image as has been exposed to light, by a reverse development operation, the non-image-forming area existing before and after the image forming area is exposed to light with the aid of an exposure lamp, whereby the potential of the non-image-forming area is lowered. By this, the possibility of variation of the potential which may otherwise be caused by continuous image forming operation and variation in the ambient conditions can be prevented. Futher, by applying a bias voltage for preventing deposition of the developer in the non-image forming area which is substantially free from potential variation, the developer is prevented from being deposited, irrespective of the variation in the ambient conditions.

23 Claims, 8 Drawing Sheets

ELECTROPHOTOGRAPHIC APPARATUS FOR DEPOSITING DEVELOPER ONLY ON THE IMAGE AREA OF THE IMAGE BEARING MEMBER

This application is a continuation of application Ser. No. 869,873 filed June 3, 1986, now abandoned.

FIELD OF THE INVENTION AND RELATED ART

The present invention relates to an electrophotographic process and an electrophotographic apparatus such as a copying machine, a microfilm reader-printer and a laser beam printer by which a negative image can be produced.

Conventionally, when an image is produced by depositing a developer at a low charge portion of an electrostatic latent image, the non-image-forming area which is not involved in the image formation is kept at a high electrical potential so as to prevent deposition of the developer thereat. In this case, there is a problem that the developer can be undesirably deposited in the non-image-forming area when the ambient condition changes. This problem arises recognized when the humidity changes or when the copies are continuously formed for a long period of time.

If the developer is deposited at the non-image forming area, the developer is wasted, and additionally the developer wastefully deposited on the image bearing member can scatter in the apparatus and contaminate the recording paper, and can be deposited on a charger, resulting in non-uniform image formation.

It has been found that the cause for the developer deposition in the non-image-forming area resulting from the change of the ambient conditions, is the change in a potential of the image bearing member.

Referring to FIG 4., there is shown a change of the electrical potential at the non-image forming area during continuous copying operation. The curve VD represents the potential at the non-image forming area. As will be understood from this Figure, the potential decreases remarkably together with the increase of the number of copies produces. The decrease of the potential at the non-image-forming area is the cause of the developer deposition at this area.

The potential change results also from a humidity change or the like, and is not desirable in an electrophotographic apparatus.

SUMMARY OF THE INVENTION

Accordingly, it is a principal object of the present invention to provide an electrophotographic apparatus of process wherein the deposition of the developer at the non-image-forming area can be prevented despite a change in the ambient conditions, when the image is produced by a reversal developing operation.

It is another object of the present invention to provide an electrophotographic apparatus, capable of operating in a first mode wherein the developer is deposited at a high charge portion of the latent image and in a second mode wherein the developer is deposited at a low charge portion, wherein the potential of the non-image-forming area hardly changes independently of the ambient conditions in any of the modes, so that the developer is not deposited on the non-image forming area without influence by the ambient condition change.

It is a further object of the present invention to provide an electrophotographic apparatus and process capable of effecting the reverse development, wherein the developer is not deposited adjacent a boundary between the image forming area and the non-image-forming area, and wherein the developer is not deposited on the non-image-forming area.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Figure 1:
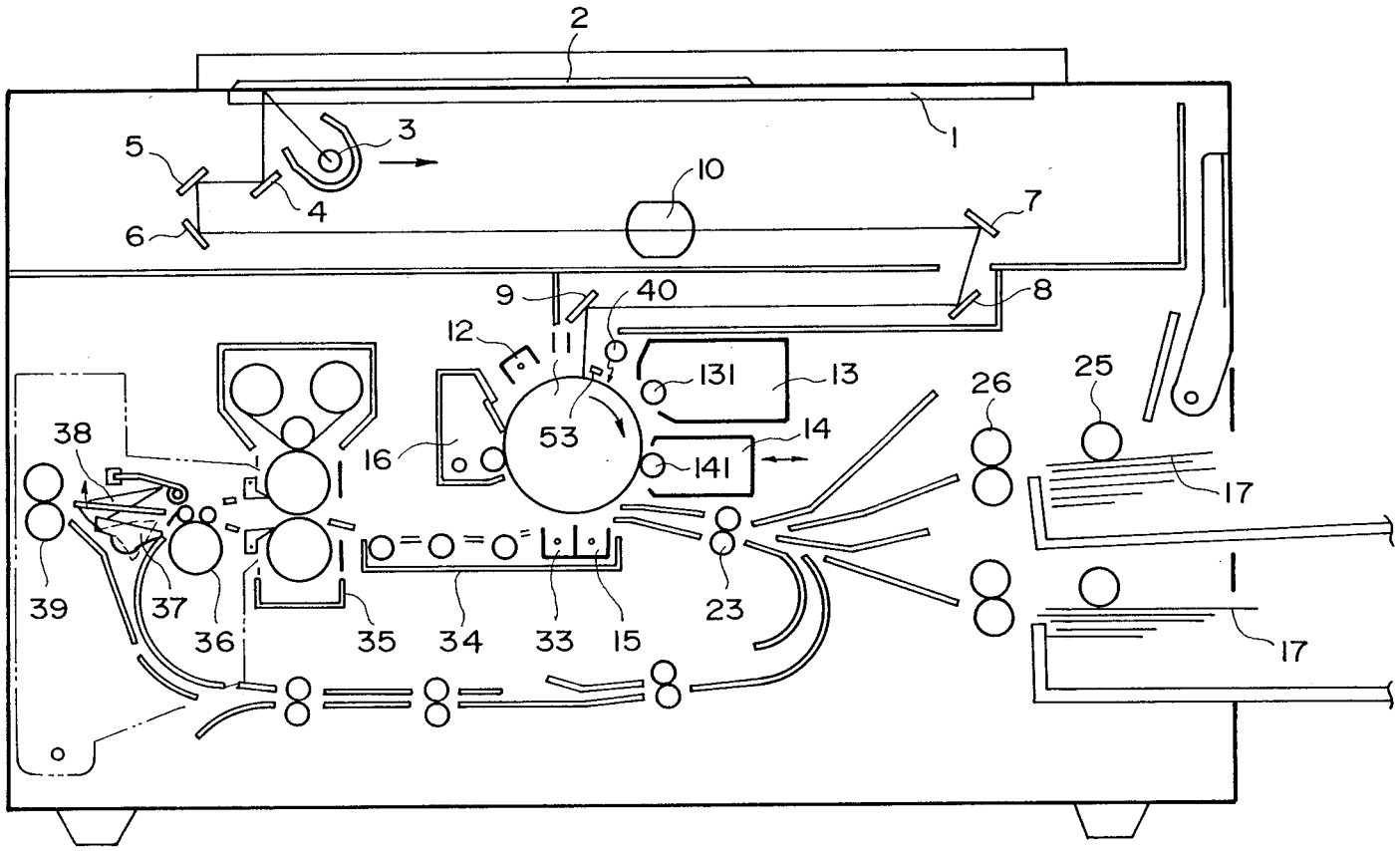
FIG. 1 is a sectional view of a copying apparatus according to an embodiment of the present invention.

The present invention will be described with respect to preferred embodiments referring to the accompanying drawings, wherein the same reference numerals are assigned to corresponding elements performing similar functions.

Referring to FIG. 1, there is shown a copying apparatus according to an embodiment of the present invention. An original to be copied is placed on an original supporting platen glass 1 and is illuminated by a lamp 3, and the resultant light image is introduced to a latent image bearing member in the form of a photosensitive drum 11 in this embodiment by an optical system including a reflecting mirrors 4, 5, 6, 7, 8 and 9 and a lens 10. The lamp 3 and mirrors 4, 5 and 6 are movable in the direction indicated by an arrow at a predetermined speed so as to scan the original 2. The photosensitive drum 11 rotates in the direction indicated by an arrow, and is subjected to a uniform electric charge by a charger 12 and is then exposed to the light image so that an electrostatic latent image is formed on the surface of the photosensitive member corresponding to the original image.

A blank exposure lamp 40 serves to uniformly illuminate the non-image-forming area of the image bearing member so as to reduce the electric charge in the non-image-forming area substantially to zero. The lamp 40 will be hereinafter also be called a "charge erasing lamp". The lamp is turned on and off by control means 401. In the following description, the "light potential area" is that area of the image bearing member surface which has been subject to the original image projecting lamp or the blank exposure lamp, whereas the, "dark potential area" is that area of the image bearing surface which has not been subjected to any of those lamps. In other words, the light potential area is a low charge portion, and the dark potential area is a high charge portion.

The term "non-image-forming area" is the area of the image bearing member which does not require deposition of the developer and which exists upstream and downstream, with respect to the movement of the image bearing member, of the image area in which an image of the original to be transferred to a recording paper is formed. The non-image-forming area corresponds to a blank of the recording paper adjacent to its the leading or trailing edge of the recording paper, necessitated by the separation of the recording paper from the photosensitive drum or the image bearing member, or corresponds to a blank provided for the purpose of filing the copies.

A potential sensor 53, is provided to measure the potential of the surface of the photosensitive member or drum, and the signal produced by this sensor is used for adjustment of the density of the image. Around the photosensitive drum 11, there are two developing devices 13 and 14, which are selectively operable in accordance with the selection by the operator. The selected developing device 13 or 14 approaches the photosensitive drum 11 in order to develop the latent image formed thereon. The other developing device 14 or 13 is spaced apart from the photosensitive drum so as not to adversely affect the developing operation.

Each of the developing devices 13 and 14 includes a developing sleeve 131 or 141 for carrying the developer to the developing position. To the developing sleeve 131 or 141 a developing bias voltage, which will be described hereinafter, is applied, so that the application of the developer to the photosensitive drum 11 is controlled.

The developing device 13 contains the developer electrically chargeable to a polarity, the same as the polarity to which the photosensitive drum 11 is charged by the charger 12. The developer is deposited onto the photosensitive drum at the light area in image forming area, which has been subjected to the light and has been deprived of the electric charge. By this, a negative, with respect to the original, image is provided as a developed image.

The developing device 14 contains a developer which is chargeable to a polarity opposite to the polarity to which the photosensitive drum 11 is charged by the charger 12. The developer is deposited on the charged portion in the image forming area of the photosensitive drum 11, so that a positive image is provided. The developed image is transferred onto the recording paper by a transfer charger 15 to which a voltage of a polarity opposite to the polarity of the developer is applied. The polarity of the voltage is changed so as to match the developing device selected. Thereafter, the photosensitive drum 11 is cleaned by a cleaner 16 so that the remaining toner is removed from the surface of the photosensitive drum 11. Thus, the photosensitive drum 11 is ready for the next image forming operation.

The recording paper 17 is supplied to the image transfer station in the following manner. The recording paper or sheet in this embodiment is fed out by a pickup roller 25 and separated by a separation roller 26 so that only one sheet is fed. The sheet is stopped by a nip formed by a registration roller couple 23 which is at rest then.

The registration roller 23 (FIG. 1) starts rotating in timed relation so that the recording sheet is in alignment with the developed or visualized image on the photosensitive drum 11. Then, the recording sheet is fed to the surface of the photosensitive drum 11 by the top guide 31 and the bottom guide 32. As described hereinbefore, the recording sheet receives the image from the surface of the photosensitive drum 11 by the transfer charger 15, and the then separated from the surface by a separation charger 33. The sheet is transported to the fixing device 35 through the transporting portion 34. By the fixing device 35, the toner image on the recording sheet is fixed into a parmanent image, and then, the recording sheet is conveyed to a first discharging roller couple 36, and is directed to the second discharging roller 39 through a first flapper 37 and a second flapper 38, and then, the sheet is discharged out of the copied apparatus.

Figure 2:
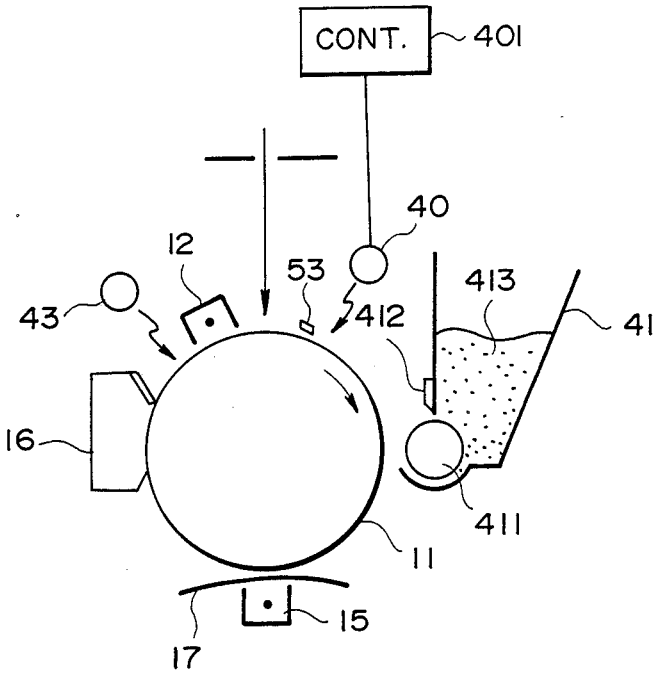
FIG. 2 is a sectional view of a copying apparatus according to another embodiment of the present invention.

Referring to FIG. 2, another embodiment the present invention will be described. Unlike the first embodiment, only one developing device 41 is used, which includes a developing sleeve 411 and a doctor blade 412, to which a developing bias formed by an alternating voltage superposed with a DC voltage is applied. The developing device 41 contains a developer 413 charged to the polarity, the same as that, to which the photosensitive drum 11 is charged. The electrostatic latent image on the photosensitive drum is reverse-developed by this developer 413 so that reversally, with respect to the original image, developed image can be provided.

The developed image thus obtained is transferred onto the recording sheet 17 by the transfer charger 11 to which a voltage having the polarity opposite to the polarity to which the developer is charged.

A pre-exposure lamp 43 serves to remove the electric charge remaining on the photosensitive member.

Figure 3:
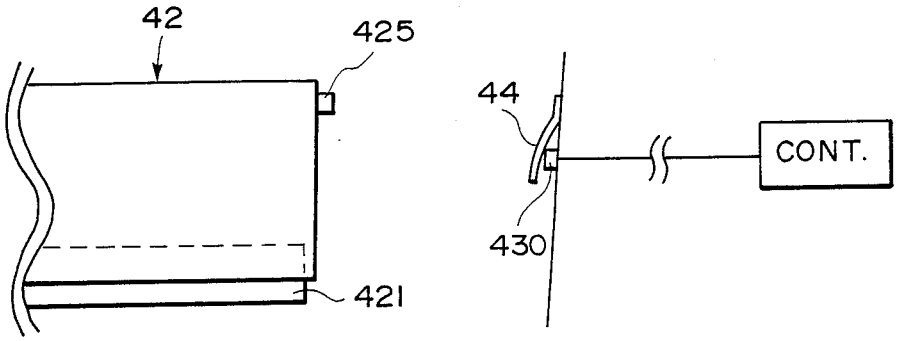
FIG. 3 illustrates a part of the apparatus according to an embodiment of the present invention.

When a direct image, with respect to the original image, is to be obtained, the developing device 41 is taken out of the copying apparatus, and another developing device 42 shown in FIG. 3, which contains the developer having the polarity opposite to that of the developer contained in the developing device 413, is loaded.

The developing device 42 has at its rear side a projecting pin 425, as shown in FIG. 3. The pin 425 is effective to push a leaf spring 44 to actuate a microswitch 430 in the copying apparatus. In response to the signal from the microswitch 430, a control circuit provided in the copying apparatus switches the polarity or the like of the voltage applied to the transfer charger and to the developing speed 421.

As will be understood, in the embodiment of FIG. 2, only the developing device is exchanged. However, it is possible that a process cartridge may be exchangeable, which contains a developing device and at least one of the other processing means, such as the photosensitive drum, the charger and the cleaner. It is also possible to exchange the photosensitive drum with another one exhibiting the opposite polarity characteristics and to change the polarity applied to the charger without changing the developing device.

A description will not be provided with respect to blank exposure and a control of the bias voltage.

Figure 4:
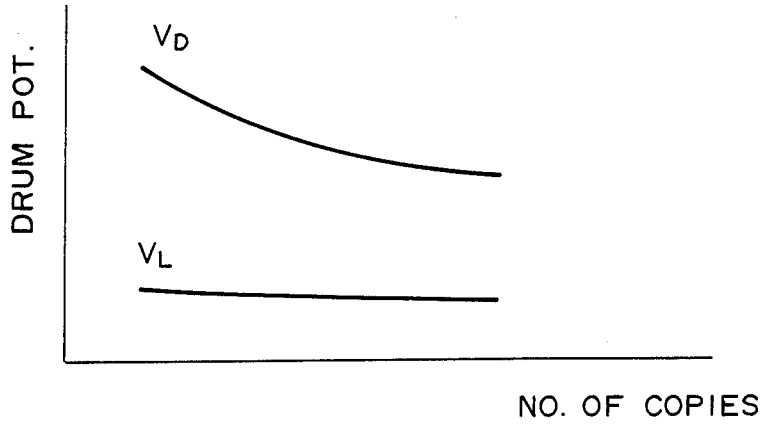
FIGS. 4 and 5 are graphs illustrating the present invention.

As described hereinbefore, the potential of the non-image-forming area of the image bearing member remarkably varies in the reverse development as shown in FIG. 4 by a reference VD. In FIG. 4, there is further shown the potential VL when the non-image-forming area is exposed to a blank exposure lamp 40. As will be understood, when the non-image-forming area is exposed, the potential hardly changes, but is substantially constant. This control of the non-image-forming area is very simple, and it is hardly influenced by the ambient conditions even if the parameters such as the bias voltage are kept constant at all times.

Next, the bias voltage application to the developing sleeve will be described, which is effective on stably prevent the deposition of the developer to the non-image-forming area with the potential at the non-image area stabilized in the above-described manner in the reverse development.

Figure 5:
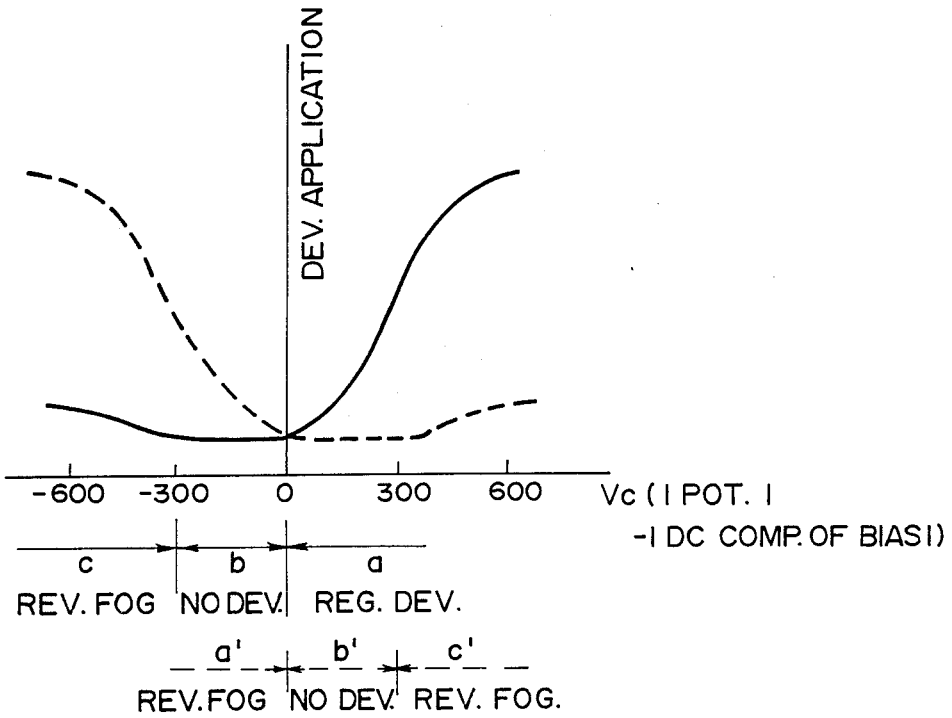

FIG. 5 shows the relation between the potential contrast which is the difference between the absolute value of the potential of the photosensitive drum and the absolute value of the DC component of the developing bias and the amount of the developer or toner deposited on the photosensitive drum, with respect to direct toner, that is, the toner used in the direct image formation mode with the present invention and with respect to reverse toner, that is, the toner used in a reverse development mode. In this Figure, the solid line represents the direct toner case, while the broken line represents the reverse toner case. In the description hereinafter, the potential of the photosensitive member and the DC component of the developing bias have the same polarity.

As will be understood from this Figure, in the region a where the absolute value of the photosensitive drum potential is higher than the absolute value of the DC component of the developing bias, regular development is effected, and the amount of the toner deposited thereon increases together with an increase of the potential contrast. Therefore, the absolute value of the developing bias voltage in the non-image-forming area is preferably higher than the absolute value of the drum potential. In the region c where the potential of the photosensitive drum is lower than the DC component of the developing bias by not less than approximately −300 V, a reverse fog results so that a slight amount of the toner is deposited. In the case of the direct image formation using the direct toner, which is the toner having the opposite polarity as that of the potential of the photosensitive member, the toner is supposed not to be deposited on the area where the developing bias is higher than the photosensitive drum potential. However, where the potential contrast is large enough, the toner particles having the opposite polarity contained in the developer can be deposited. This is called "reverse fog". A similar phenomena occurs in the case of the reverse development. In this case, it results when the photosensitive drum potential is very large as compared with the developing bias.

In a region b, which is the even better region without the reverse fog, the absolute value of the DC component of the developing bias is higher than the absolute value of the photosensitive drum potential by 0–300 V in the case of the direct toner, namely, the absolute value is larger than the development starting potential and the absolute value is less than the reversal fog starting potential. In this case, the bias voltage and the potential of the photosensitive member have the same polarity. The development starting potential is the boundary between the region a and the region b, that is, the potential of the photosensitive drum. The reverse fog starting voltage is the boundary between the region b and the region c, that is, approximately 300 V higher than the surface potential of the photosensitive member.

Similarly, in the case of the reverse toner, in the region a′ where the absolute value of the photosensitive drum potential is lower than the absolute value of the DC component of the developing bias, regular development is effected, in which the amount of the toner deposited increases together with decrease of the potential contrast. When the absolute value of the photosensitive drum potential is larger than the absolute value of the DC component of the developing bias voltage, the toner is not deposited onto the photosensitive drum. In the region c′ where the photosensitive drum or member potential is higher than the DC component of the developing bias voltage by not less than approximately 300 V, the reverse fog occurs by which a slight amount of toner is deposited. Therefore a, further preferable ranges is the range b′ without the toner deposition, where the DC component of the developing bias is lower than the photosensitive drum potential by 0–300 V, that is, the absolute value is less than the development starting potential and the absolute value is larger than the reversal fog starting potential. The development starting potential is the boundary between the range a′ and the range b′, while the reverse development starting potential is the boundary between the region b′ and the region c′, namely, a potential approximately 300 V lower than the photosensitive drum potential.

The development starting potential and the reverse fog starting potential differ depending on method of producing the toner, the kind of the toner and the method of development. Therefore, the potential values given in the above paragraphs are not limited but can be determined by one of ordinary skill in the art depending on situation. However, the value of 300 V is applicable to almost all of the kinds and methods of development to prevent the reverse fog.

Figure 6:
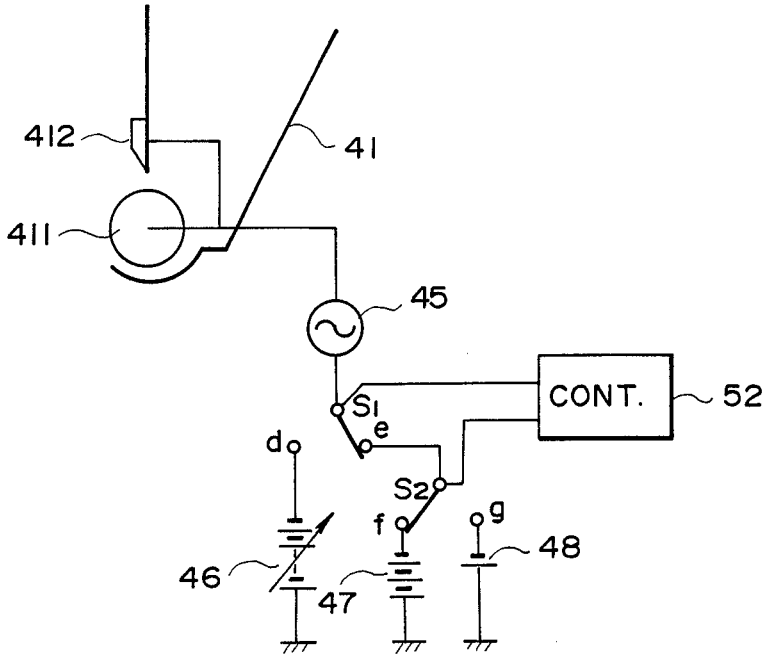
FIG. 6 illustrates a developing bias applying system according to an embodiment of the present invention.

FIG. 6 is a schematic drawing illustrating a means for applying the developing bias. An AC voltage 45 superimposed with a DC voltage is applied to the developing sleeve 411 of the developing device 41 and the doctor blade 412 thereof, which is made of magnetic material in this embodiment. The switch S1 serves to switch the bias voltage. When the developing device develops the image area of the photosensitive drum, the switch S1 is contacted to the contact d so that the DC voltage 46 is used, and the DC voltage is controllable so as to provide an optimum image can be provided. The same bias voltage is applied to the doctor blade 412 and the developing sleeve in order to prevent disturbance of the toner which may otherwise be caused by the potential difference between the blade 412 and the sleeve 411.

When the non-image-forming area is at the developing position, the switch S1 selects the contact e, and a switch S2 selects the contact f in the case of the direct image formation so that a predetermined developing bias 47 (−350 V) is applied. When the reverse image is to be formed, the switch S2 is contacted to the contact g, and the developing bias predetermined therefor (−50 V) is applied. The switching of the developing bias voltage is effected by the control means 52.

It is not always necessary to apply the bias voltage to the doctor blade 412, and the doctor blade 412 may be composed of non-magnetic material.

In this case, the unshown photosensitive drum is electrically charged to approximately −800 V. When the developing device containing the toner positively charged is used, the toner is deposited at the high charge area of the latent image formed on the photosensitive drum. The non-image-forming area is blank-exposed, whereby the potential of the photosensitive drum in this area is lowered to approximately −200 V. Since the developing bias for this area is −350 V, which has an absolute value larger than the drum potential, and the difference is approximately 150 V, the toner is not deposited on the photosensitive drum.

When, on the other hand, the developing device containing the toner negatively charged is used, the toner is deposited at a lower charge area of the latent image formed on the photosensitive drum. In this case also, the non-image-forming area is blank-exposed so that the potential of the photosensitive drum is decrease to +200 V. The developing bias is −50 V, which has an absolute value smaller than the drum potential, and the difference is approximately 150 V, and therefore, the toner is not deposited onto the photosensitive drum.

It is most preferable that the blank-exposure of the non-image-forming area is performed for each of the image forming operations. But this is not always necessary.

More particularly, even when the potential of the non-image-forming area decreases, the blank-exposure is not necessary as long as the amount of the decrease does not result in the problem practically. In this case, however, when the drum surface potential decreases further to such an extent that the toner is deposited on that area, the above-described blank exposure and the developing bias application are carried out. This can be automatically controlled on the basis of the potential detected by a potential sensor 53.

Generally, in an electrophotographic apparatus operable in a first mode wherein the toner is deposited onto the light potential area and in a second mode wherein the toner is deposited on the dark potential area, a large amount of charge existing in the non-image-forming area can deteriorate for the next image due to the hysteresis of the photosensitive member particularly when the next image formation is in the mode different from that of the previous image formation. The blank exposure of the non-image-forming area in the reverse development according to the present invention is effective to eliminate this influence.

Figure 7:
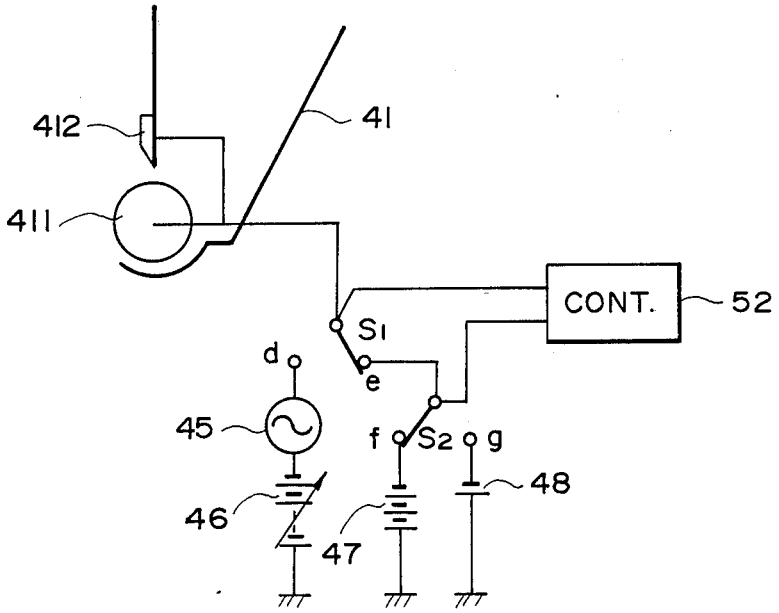
FIG. 7 illustrates a developing bias applying system according to another embodiment of the present invention.

FIG. 7 is a schematic drawing of a means for applying the developing bias according to the present invention. The operation of the switches is similar to those of FIG. 6 embodiment. However, in the present embodiment, the developing bias applied for the sake of the non-image-forming area is not superimposed with the AC component, rather it consists only of a DC component. Such a voltage is applied both to the sleeve 411 and the blade 412.

Generally, the method of development wherein the superposed DC voltage and AC voltage is applied to the developing means, is preferred since the development is sensitive even to a small potential difference of the latent image, and the tone reproducibility is better.

It is possible that because of an unavoidable potential non-uniformity in the non-image-forming area, a very small amount of the toner can be deposited. This problem is solved by the FIG. 7 embodiment, wherein the bias voltage is only of the DC component for the sake of the non-image-forming area. This is effective to prevent the toner deposition even under the condition of the non-uniform potential in the non-image-forming area, thus providing the better toner deposition preventing effect.

Figure 8:
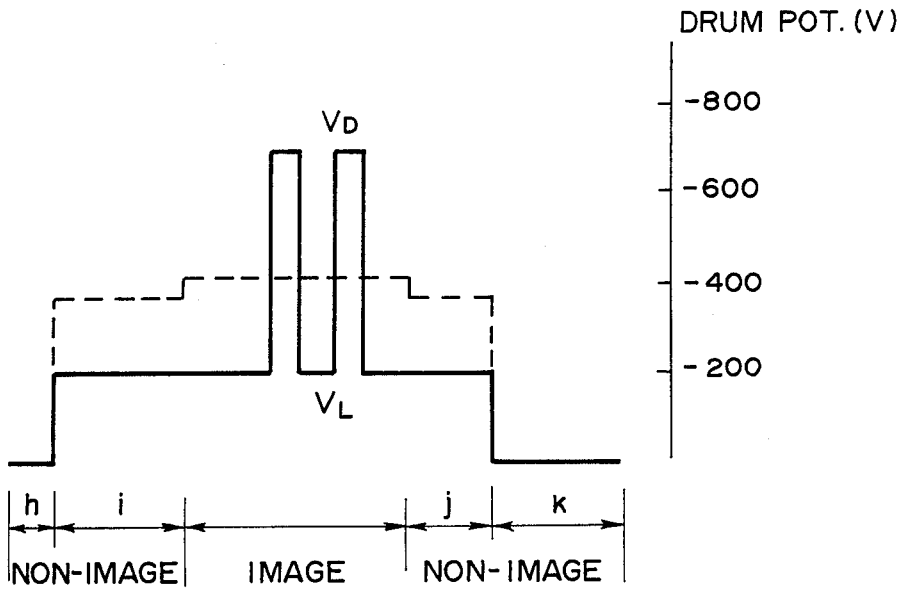
FIG. 8 shows the potential of the image bearing member in an apparatus according to an embodiment of the present invention.

FIG. 8 illustrates the relation between the photosensitive drum potential and the DC component of the developing bias during one cycle of image formation when the latent image is developed with the toner having a polarity opposite to that of the drum potential in this embodiment. The solid line represents the photosensitive drum or member potential, whereas the broken line represents the developing bias. The potential of the area to which the toner is to be deposited and the background area potential are represented by VD and VL, respectively. The suitable developing bias is applied to obtain an optimum image. In parts h and k of the non-image-forming area, the primary charge is not applied so that the potential is approximately 0 volt, and the parts i and j of the non-image area are subjected to the charge erasing exposure, so that the potential of the photosensitive drum is approximately −200 V. The developing bias for the non-image area parts i and j is −350 V DC. Therefore, the potential contrast between the potential of the non-image area of the photosensitive member and the developing bias is −150 V. As will be understood from FIG. 5, neither of the regular development and the reverse fog results.

Figure 9:
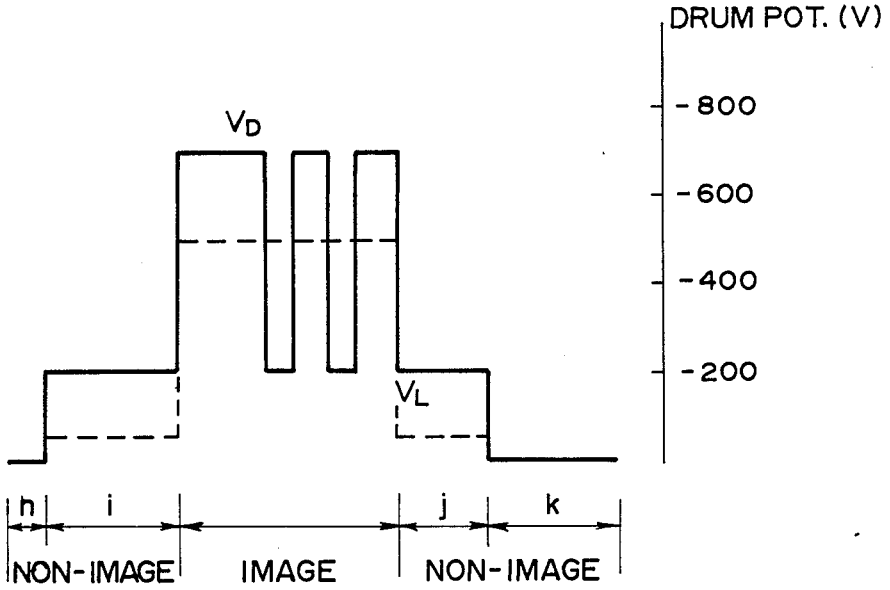
FIG. 9 shows the potential of the image bearing member in an apparatus according to an embodiment of the present invention.

FIG. 9 illustrates the relation between the surface potential of the photosensitive drum and the DC component of the developing bias during one cycle of the image formation when the latent image is developed with the toner having the same polarity as that of the drum potential in this embodiment. The solid line represents the photosensitive drum potential, and the broken line represents the developing bias. The background potential and the potential of the area to which the toner is to be desposited are represented by VD and VL, respectively. A suitable developing bias is applied to obtain a proper image. For the parts h and k of the non image area, the primary charge is not applied so that the potential thereat is approximately 0 volt, whereas, the parts i and j of the non-image area are subjected to the charge erasing exposure so that the potential of the photosensitive member is approximately −200 V. The developing bias for the parts i and j of the non-image-forming area is −50 V DC. Therefore, the potential contrast between the photosensitive member potential and the developing bias in those non-image-forming areas is +150 V, with which the toner is not deposited as will be understood from FIG. 5.

The reverse fog starting voltage differs slightly depending on the characteristics of the toner and the setting of the charging level, but the value of 300 V shown in FIG. 5 is practical upper limit for the prevention of the reverse fog.

In the foregoing embodiments, the same photosensitive drum for the photosensitive drum having the same characteristics are used, while the charging property of the toner is changed, whereby the toner is deposited on either the high charge portion or the low charge portion of the latent image. It is, however, a possible alternative that the same toner charging property is used, while the different photosensitive drum having the different charging property is used, so that the same effects are provided.

Figure 10:
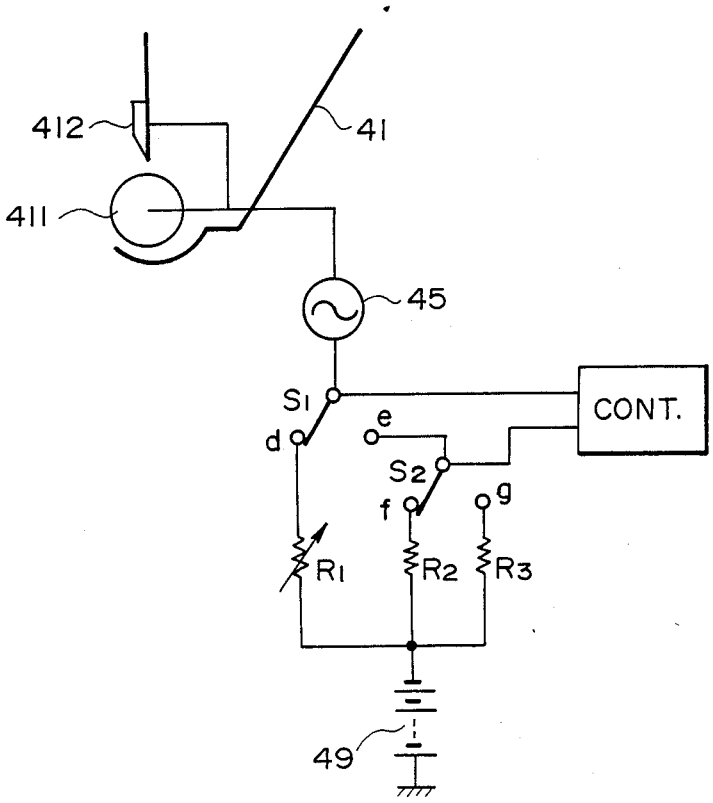
FIG. 10 illustrates a developing bias applying system according to another embodiment of the present invention.

FIG. 10 shows a further means for applying the developing bias according to a further embodiment of the present invention.

In this embodiment, the DC component of the developing bias is controlled using selectively the resistor R1, R2 and R3 using one DC voltage source 49, instead of selecting from plural DC power source in accordance with the required developing bias. According to this embodiment, plural bias voltages can be obtained by a single DC source with the advantages from the standpoint of reducing the size of the apparatus and the cost of manufacturing the apparatus.

Similar to the embodiment of FIG. 7, it is also preferable in this embodiment that the AC power source 45 is connected between the contact d and the resistor R1 so that the bias voltage only of the DC component is applied to the developing means for the sake of the non-image-forming area.

Figure 11:
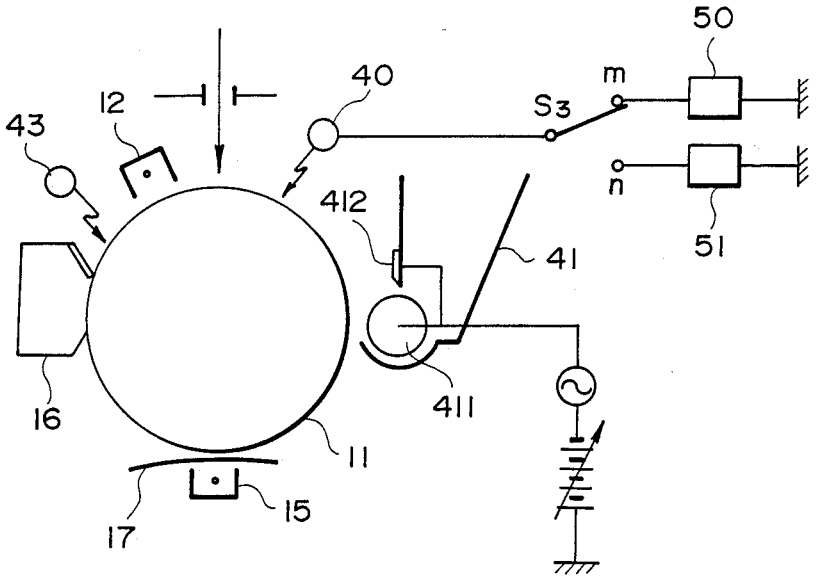
FIG. 11 is a sectional view of an apparatus according to a further embodiment of the present invention.

FIG. 11 illustrates a further embodiment of the present invention.

In the foregoing embodiments, the quantity of illumination of the non-image-forming area by the blank exposure lamp is constant. However, it is possible to control the potential difference between the drum potential and the developing bias to prevent the toner deposition, by changing the quantity of illumination between when the direct image is provided and when the reverse image is provided. More particularly, the exposure amount is made smaller in the second mode wherein the reverse image is provided than in the first mode wherein the direct image is provided. By doing so, the level of the DC component of the bias voltage in the first mode can be closer to that in the second mode. When the difference in the amounts of the exposure is within a predetermined level, the deposition of the toner can be prevented even if the bias voltage is the same, irrespective of the modes.

In the embodiment of FIG. 11, the developing bias is not changed. Instead, the amount of exposure at the charge erasing exposure step is changed, thus changing the potential at the non-image forming area of the photosensitive member. In the mode for depositing the toner at the dark potential area of the image forming area, the charge erasing lamp 40 is connected to the power source 50 by the switch S3 contacting a contact m. In the mode for depositing the toner to the light potential area of the image forming area, the charge erasing lamp 40 is connected to the power source 51 by the switch S3 contacting to a contact n. The power sources 50 and 51 provide the charge erasing lamp 40 with different voltages, so that the amounts of the exposure are different.

Figure 12:
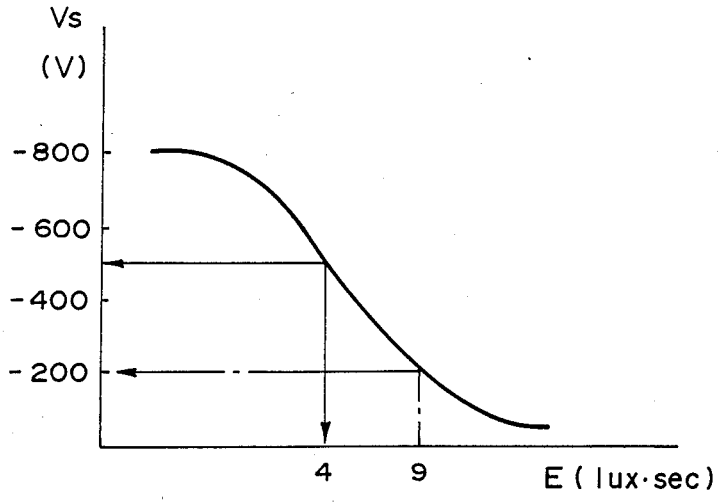
FIG. 12 is a graph showing the voltage in an apparatus according to the present invention.

FIG. 12 is an E/V characteristic curve illustrating the photosensitive member potential Vs and the amount of exposure E. In this embodiment, 9 lux.sec is used in the mode wherein the toner is deposited in the dark potential area, so that the non-image forming area potential is −200 V. In the other mode, 4 lux.sec is used, with the result of −500 V in the non-image-forming area, as shown in FIG. 12. The developing bias is −350 V in both of the modes. Therefore, the potential contrasts are −150 V and +150 V, respectively in the mode wherein the toner is deposited at the dark potential area of the image forming area and in the mode wherein the toner is deposited at the light potential area thereof. As will be understood from FIG. 5, the toner is not deposited in the non-image forming area.

In this embodiment, the voltage applied to the charge erasing exposure lamp 40 is changed to control the amount of the exposure. However, it is possible to use a filter or slit for controlling the amount of light, disposed between the charge erasing exposure lamp 40 and the photosensitive member 11. The filter may be inserted across the optical path, or the width of the slit may be narrowed only upon the mode wherein the toner is deposited at the light potential area.

A description will be provided of the timing of the actuating the blank exposure lamp and the switching of the bias voltage when the bias voltage is made different between the non-image-forming area and the image forming area. It is most preferable that the portions of the photosensitive member corresponding to the actuation and deactivation of the blank exposure lamp are exactly in accord with the changes of the bias voltage. This, however, is difficult because there are transient periods at the actuation and the deactivation of the blank exposure lamp, and the transient periods vary. Sometimes, the toner is deposited in a line adjacent the boundary between the image forming area and the non-image-forming area. This has been found to be remarkable in the reverse development mode wherein the toner is deposited at the light potential area of the image forming area. This is because the potential at the non-image-forming area is lowered very much by the blank exposure, so that the non-image-forming area easily catches the toner without the control by the bias voltage.

Figure 13:
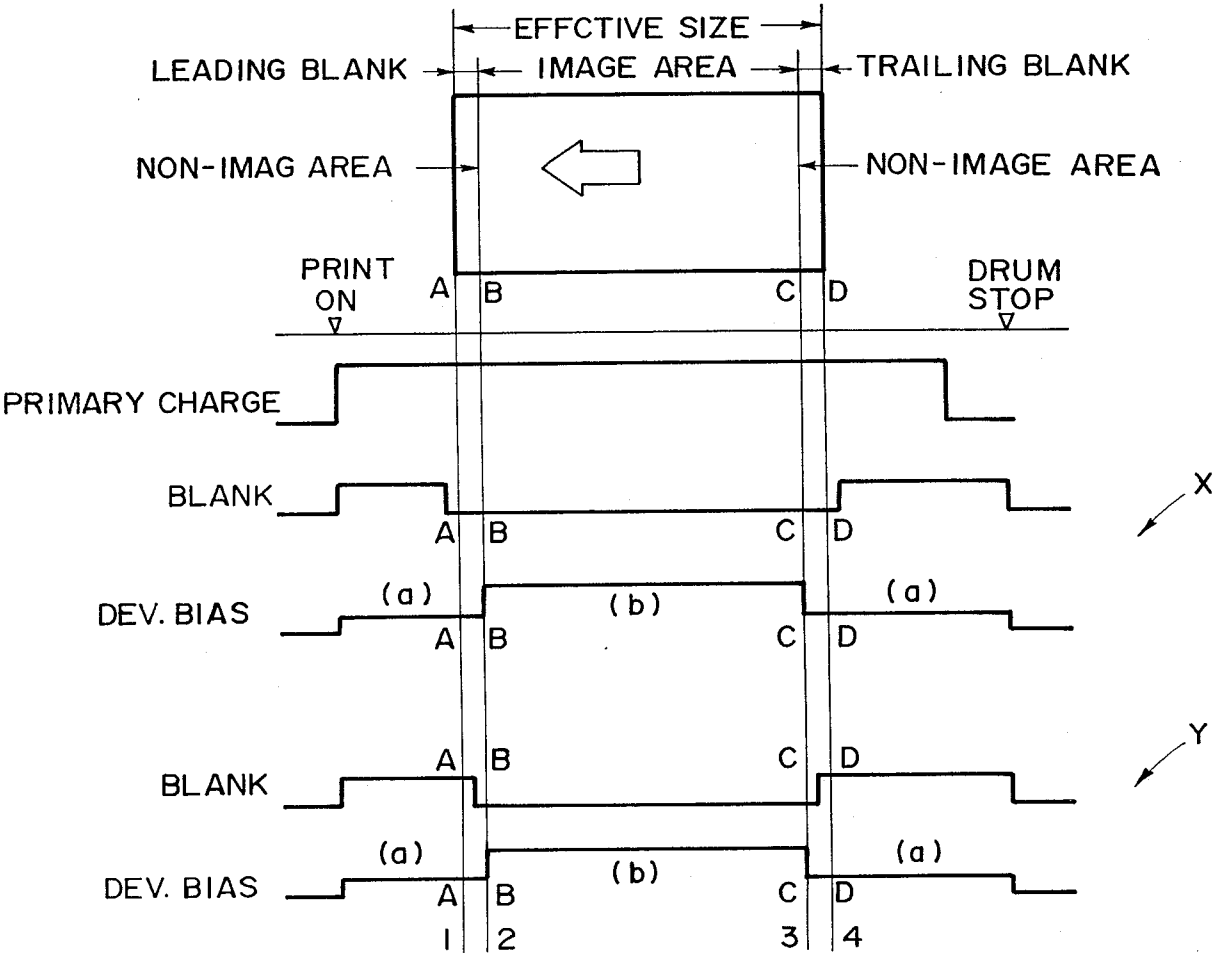
FIG. 13 is a timing chart in an apparatus according to a further embodiment of the present invention.

Referring to FIG. 13, there is shown a timing chart in an embodiment according to the present invention, wherein the operations of the primary charging, the blank exposure and the DC component of the developing bias voltage are represented, in the case of reverse development. Particularly, the relation between the blank exposure timing and the developing bias change timing is shown with respect to the effective size of the recording sheet. The positions of the primary charger, the blank exposure lamp and the developing device are different. It should be noted that FIG. 13 are on the basis of the position on the photosensitive member or drum. Adjacent the leading and trailing edges of the effective size of the sheet, there are blanks, and the timing control of the blank exposure and the developing bias change is controlled utilizing those blanks. Upon the production of the printing signal, the drum starts to rotate, and the primary charger is actuated so that the uniform charging is effected until one sequential operation completes. In FIG. 13, the blank exposure and the developing bias are actuated simultaneously with the production of the printing signal. The blank exposure terminates a few millimeters before the leading edge A of the sheet, and is actuated a few millimeters after the trailing edge D of the sheet, so as to produce the non-image-forming area potential. At this time, the developing bias is the non-imaging bias (a) for not effecting development in the blank area B from the time of the production of the printing signal to the leading edge of the sheet, and the image forming area, the bias voltage (b) in accordance with the original is set. In the region from the trailing blank C to the point of the drum stop, the non-image forming bias is applied.

In FIG. 13, the blank exposure control is effected in the middle of the leading blank and the trailing blank, and the bias control is effected at the boundary between the image forming area and the non-image forming area.

When it is not necessary to form a blank adjacent a leading edge of the sheet or the trailing edge of the sheet, the bias control is carried out at A and D in this Figure. The blank exposure lamp is turned on prior to the A position and turned off after the position b. In other words, at the boundary between the non-image-forming area and the subsequent image forming area, the blank exposure lamp is turned off, and thereafter, the bias voltage is switched. On the contrary, at the boundary between the image forming area and the subsequent non-image-forming area, the blank exposure lamp is actuated after the bias voltage is switched. By this, when the image forming area is subsequent to the non-image-forming area, the blank exposure is stopped at a time during the bias voltage for the sake of non-image-forming area being applied, whereby the small area required for turning off the blank exposure and switching the bias voltage is controlled by the bias voltage most effectively to prevent the toner deposition, so that the toner is hardly deposited. However, since the potential of the drum is high because the blank exposure is not effected, the reverse fog can occur. Nevertheless, it is not practically a problem since the toner deposition by the reverse fog is small and because the area is small.

Accordingly, even if there is a slight deviation of the control timing, it can be prevented that the blank exposure lamp is on after the bias voltage is switched. It should be noted that the blank exposure is effected at a position after the bias voltage is switched to that for the image forming area, the area is such that it can catch the toner very easily, with the result of a line of the toner image on the recording sheet. Since the switching of the bias voltage is at the boundary between the non-image forming area and the image forming area, it is not possible that there appears a non-developable area in the image forming area.

According to this embodiment, the toner deposition at the non-image-forming area can be positively prevented even if the timing of the blank exposure control varies. On the contrary, at the boundary between the image forming area and the subsequent non-image-forming area, the blank exposure lamp is deactivated after the bias voltage is switched for the prevention of the toner deposition at the non-image forming area, by which even if the timing of the actuation or activation of the blank exposure varies, there is not formed the area which can easily catch the toner. Therefore, the toner deposition at the non-image forming area can be prevented positively. Additionally, since the switching of the bias voltage is in accord with the boundary between the image forming area and the non-image-forming area, the non-developable area is formed in the image forming area.

It should be noted that any combination of the embodiments described in the foregoing are possible as a part of the present invention.

While the invention has been described with reference to the structures disclosed herein, it is not confined to the details set for and this application is intended to cover such modifications or changes as may come within the purposes of the improvements or the scope of the following claims.

What is claimed is:

1. An electrophotgraphic apparatus, comprising:

an image bearing member;

means for developing a latent image formed on said image bearing member by depositing a developer onto a light potential area of the latent image which has been exposed to light;

bias voltage applying means for applying a bias voltage to said developing means; and means for exposing a non-image-forming area of said image bearing member to light;

wherein the bias voltage applied to said developing means for the image forming area is different from that for the non-image-forming area, and wherein the bias voltage for the image forming area is effective to deposit the developer in the light potential portion, whereas the bias voltage for the non-image-forming area is effective to prevent deposition of the developer.

2. An apparatus according to claim 1, wherein said developing means develops using a latent image by the developer chargeable to the polarity of the charging polarity of said image bearing member.

3. An apparatus according to claim 2, wherein said bias voltage applying means applies, for the non-image forming area of said image bearing member, of bias voltage including a DC component having the same polarity as that of the charging polarity of said image bearing member and having an absolute value smaller than the absolute value of the surface potential of the non-image-forming area of said image bearing member.

4. An apparatus according to claim 3, wherein said bias voltage applying means applies, for the non-image forming area of said image bearing member, to said developing means a bias voltage including a DC component which is different from the surface potential of the non-image-forming area by not more than 300 V.

5. An apparatus according to claim 1, wherein said bias voltage applying means applies, for the image forming area, to said developing means a bias voltage provided by superimposing a DC current and an alternating current, and applies, for the non-image forming area, to the developing means a bias voltage including only a DC component.

6. An electrophotographic apparatus comprising:

developing means for depositing, in a first mode of operation of said apparatus, a developer on the dark potential portion of a latent image formed on an image bearing means which has not been exposed to light, and for depositing, in a second mode of operation of said apparatus, another or the same developer on a light potential area of the latent image on the image bearing means which is exposed to light;

exposure means for exposing a non-image forming area of the image bearing means in both of said first mode and said second mode; and bias voltage applying means for applying a bias voltage to said developing means, wherein said bias voltage applying means applies a bias voltage for preventing deposition of the developer in the non-image-forming area in both of said first mode and said second mode.

7. An apparatus according to claim 6, wherein in said first mode, said developing means develops the latent image by a developer chargeable to a polarity opposite to the charge of said image bearing means, and in said second mode, said developing means develops the latent image by a developer chargeable to a polarity, the same as the polarity of the charge of said image bearing means.

8. An apparatus according to claim 6, further comprising control means for controlling said exposure means so as to decrease the amount of exposure of said image bearing member in said second mode as compared with said first mode.

9. An Apparatus according to claim 8, wherein said bias voltage applying means applies a bias voltage having a DC component for the non-image forming area which is the same in said first mode and in said second mode.

10. An apparatus according to claim 6, wherein the amount of exposure produced by said exposure means of the non-image forming area of the image bearing means is the same in said first mode and in said second mode, and wherein said bias voltage applying means applies a bias voltage that is different in said first mode and in said second mode to prevent toner deposition in the non-image-forming area.

11. An apparatus according to claim 6, wherein said developing means includes at least two developing devices which are used for said first mode and said second mode.

12. An apparatus according to claim 6, wherein said apparatus is capable of accommodating either of first mode developing device or second mode developing device as said developing means.

13. An apparatus according to claim 6, wherein in said second mode, said bias voltage applying means applies different bias voltages to said developing means, for the image forming area and for the non-image forming area.

14. An apparatus according to claim 12, wherein said bias voltage applying means applies, for the image forming area, to said developing means a bias voltage provided by superimposing a DC current and an alternating current, and applies, for the non-image forming area, to the developing means a bias voltage including only a DC component.

15. An apparatus according to claim 7, wherein in said second mode, the surface potential of the non-image forming area of the image bearing means and the DC component of the bias voltage for the non-image forming area have the same polarity, and wherein the absolute value of the DC component of the bias voltage for the non-image-forming area is larger in the first mode and smaller in the second mode than the absolute value of the surface potential of the non-image-forming area of said image bearing means.

16. An apparatus according to claim 15, wherein the difference between the surface potential of the non-image-forming area of said image bearing means and the DC component of the bias voltage is not more than 300 V.

17. An electrophotographic apparatus, comprising;

an image bearing member;

charging means for uniformly charging said image bearing member;

developing means for developing a latent image formed on said image bearing member by a developer charged to a polarity, the same as the polarity to which said image bearing member is charged;

bias voltage applying means for applying a bias voltage to said developing means;

first control means for changing the bias voltage depending on whether said bias voltage is used for controlling the operation of said developing means with respect to the image forming area or the non-image-forming area;

exposure means for exposing the non-image forming area of said image-bearing member; and second control means for controlling said exposure means, wherein said first control means changes the bias voltage at a position on said image bearing member which corresponds to a position thereof where said second control means turns off said exposure means.

18. An apparatus according to claim 17, wherein said first control means controls said bias voltage applying means so that a DC component of the bias voltage for the non-image-forming area has the same polarity, as that of said image bearing member and has an absolute value smaller than the potential of the non-image-forming area of said image bearing member.

19. An apparatus according to claim 18, wherein said first control means controls the bias voltage so that the difference between the potential of the non-image-forming area and the DC component of the bias voltage is not more than 300 V.

20. An apparatus according to claim 17, wherein said first control means controls said bias voltage applying means so that a bias voltage of superimposed AC and DC is applied for the image forming area, whereas for the non-image-forming area, the bias voltage has only a DC component.

21. An apparatus according to claim 17, wherein said first control means changes the bias voltage at a position on said image bearing member which corresponds to a position where said second control means activates said exposure means and wherein said second control means actuates said exposure means at a position after the position where said first control means changes the bias voltage adjacent to a boundary between the image forming area and the non-image-forming area subsequent thereto.

22. An apparatus according to claim 17, wherein said first control means changes the bias voltage at a position after the position where said second control means turns off said exposure means adjacent to a boundary between the non-image-forming area and the image forming area subsequent thereto.

23. An image forming apparatus, comprising:

an image bearing member;

means for forming a latent image having a high potential portion and a low potential portion on said image bearing member;

means for developing the latent image by depositing a developer on the low potential portion of the latent image;

means for electrically discharging a non-image area of said image bearing member; and control means for controlling said developing means to prevent the developer from being deposited on the non-image area of said image bearing member.

* * * * *

UNITED STATES PATENT AND TRADEMARK OFFICE

CERTIFICATE OF CORRECTION

PATENT NO. :4,847,657

DATED :July 11, 1989

INVENTOR(S) :SHINJI HANADA, ET AL.

It is certified that error appears in the above-identified patent and that said Letters Patent is hereby corrected as shown below:

COLUMN 1

Line 44, "produces." should read --produced.--.

COLUMN 2

Line 59, "a" (first occurrence) should be deleted.

COLUMN 3

Line 23, "its" should be deleted.
Line 52, "image" should read --the image--.

COLUMN 4

Line 19, "the then separated" should read --is then separated--.
Line 23, "parmanent" should read --permanent--.
Line 29, "embodiment the" should read --embodiment of the--.

COLUMN 5

Line 4, "not" should read --now--.
Line 19, "on" should read --to--.
Line 20, "developer to" should read --developer on--.
Line 61, "the" (second occurrence) should be deleted.

UNITED STATES PATENT AND TRADEMARK OFFICE

CERTIFICATE OF CORRECTION

PATENT NO. : 4,847,657

DATED : July 11, 1989

INVENTOR(S) : SHINJI HANADA, ET AL.

It is certified that error appears in the above-identified patent and that said Letters Patent is hereby corrected as shown below:

COLUMN 5

Line 65, "In a region b," should read --In the region b,-- and "is the" should read --is an--.

COLUMN 6

Line 3, "reversal" should read --reverse--.
Line 27, "ranges" should read --range--.
Line 45, "on situation." should read --on the situation--.
Line 58, "can be provided" should be deleted.

COLUMN 7

Line 24, "decrease" should read --decreased--.

COLUMN 10

Line 63, "and the image" should read --and in the image--.

UNITED STATES PATENT AND TRADEMARK OFFICE

CERTIFICATE OF CORRECTION

PATENT NO. : 4,847,657

DATED : July 11, 1989

INVENTOR(S) : SHINJI HANADA, ET AL.

It is certified that error appears in the above-identified patent and that said Letters Patent is hereby corrected as shown below:

COLUMN 13

Line 56, "comprising;" should read --comprising:--.

Signed and Sealed this

First Day of October, 1991

*Attest:*

*Attesting Officer*

HARRY F. MANBECK, JR.

*Commissioner of Patents and Trademarks*